US005743472A

United States Patent [19]

Williams, Jr. et al.

[11] Patent Number: 5,743,472

[45] Date of Patent: Apr. 28, 1998

[54] MATERIAL REDUCTION APPARATUS

[75] Inventors: Robert M. Williams, Jr., St. Louis; Paul H. Becherer, Festus, both of Mo.

[73] Assignee: Williams Patent Crusher & Pulverizer Company, St. Louis, Mo.

[21] Appl. No.: 790,075

[22] Filed: Jan. 28, 1997

[51] Int. Cl.[6] ..... B02C 13/31

[52] U.S. Cl. ..... 241/32; 241/36; 241/73; 241/239; 241/285.3

[58] Field of Search ..... 241/73, 285.3, 241/32, 36, 242, 239, 241, 37

[56] References Cited

U.S. PATENT DOCUMENTS

| | | | |
|---|---|---|---|
| 730,503 | 6/1903 | Williams . | |
| 2,853,247 | 9/1958 | Anderson | 241/285.3 |
| 3,419,223 | 12/1968 | Morin | 241/285.3 |
| 3,823,878 | 7/1974 | Ishikura . | |
| 4,557,421 | 12/1985 | Probst et al. | 241/73 |
| 4,706,899 | 11/1987 | Parker et al. . | |
| 5,213,273 | 5/1993 | Linnerz | 241/285.3 |
| 5,273,218 | 12/1993 | Burns | 241/285.3 |
| 5,299,744 | 4/1994 | Garmater . | |
| 5,474,239 | 12/1995 | Williams, Jr. et al. . | |

FOREIGN PATENT DOCUMENTS

| | | | |
|---|---|---|---|
| 558654 | 6/1958 | Canada | 241/73 |
| 405084451 | 4/1993 | Japan | 241/73 |

*Primary Examiner*—Mark Rosenbaum
*Attorney, Agent, or Firm*—Polster, Lieder, Woodruff & Lucchesi, L.C.

[57] ABSTRACT

Material shredding apparatus having a motor driven shaft carrying a material shredding rotor operatively mounted in a housing assembly adjacent a pivotally yieldable material shredding cutter and a shredded material sizing screen pivotally movable between a position in abutment with the pivotally yieldable shredding cutter and a shredder material receiving position adjacent the shredding rotor. The assembly being provided with electrical safety cutoff circuit means operative upon loss of shear pin support means for the material sizing screen and shredding cutter for stopping current supply to the motor driven shaft to avoid damage to the housing assembly by encountering tramp material to hard to shred by the shredding cutter.

4 Claims, 2 Drawing Sheets

MATERIAL REDUCTION APPARATUS

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

This invention is directed to preventing destruction of apparatus while grinding and granulating metallic material when tramp material jams the rotor which results in damage to the apparatus.

1. Description of the Prior Art

In the apparatus normally provided for processing material by shredding, crushing or grinding, there is a problem which has not yet been solved. For example, in the apparatus disclosed in Ishikura U.S. Pat. No. 3,823,878 of Jul. 16, 1974, Parker et al. U.S. Pat. No. 4,706,899 of Nov. 17, 1987, or Garmater U.S. Pat. No. 5,299,744 of Apr. 5, 1994, or Williams et al. U.S. Pat. No. 5,474,239 of Dec. 12, 1995, there is no way of avoiding damage to the apparatus should tramp material get into the flow of material to cause jamming and destruction before the driving motor can be shut down. The high speed of such apparatus makes it especially difficult to prevent internal damage where a tramp object is encountered.

BRIEF SUMMARY OF THE INVENTION

In the grinding reduction of metallics, a motor driven rotor is mounted in a frame and is positioned adjacent the feed inlet for receiving metallic material to be granulated. The rotor has a close running fit with a screen through which the reduced material is discharged. In order to guard against damage due to the pressure of tramp material and the destruction results caused thereby, the improved apparatus is provided with a pivotally mounted cutter which is held in the grinding position by a shear pin which also supports the cutter and the adjacent edge of a screen. The screen is supported on a hinge spaced from the position of the cutter, and from the shear pin which holds the screen in operating position.

In the event of the presence of hard to grind tramp material being fed into the apparatus, the force imposed on the cutter causes damage to the housing in the area of the cutter position. Preventing the occurrence of housing damage is of utmost importance and the provision of a shear pin to release the screen and the cutters for relieving the overload on the housing achieves the desired result. The result is that the screen and cutter swing out of the way to clear the apparatus.

BRIEF DESCRIPTION OF THE SEVERAL VIEWS OF THE DRAWINGS

The embodiments of the invention are shown as follows.

DETAILED DESCRIPTION OF THE INVENTION

Figure 1:
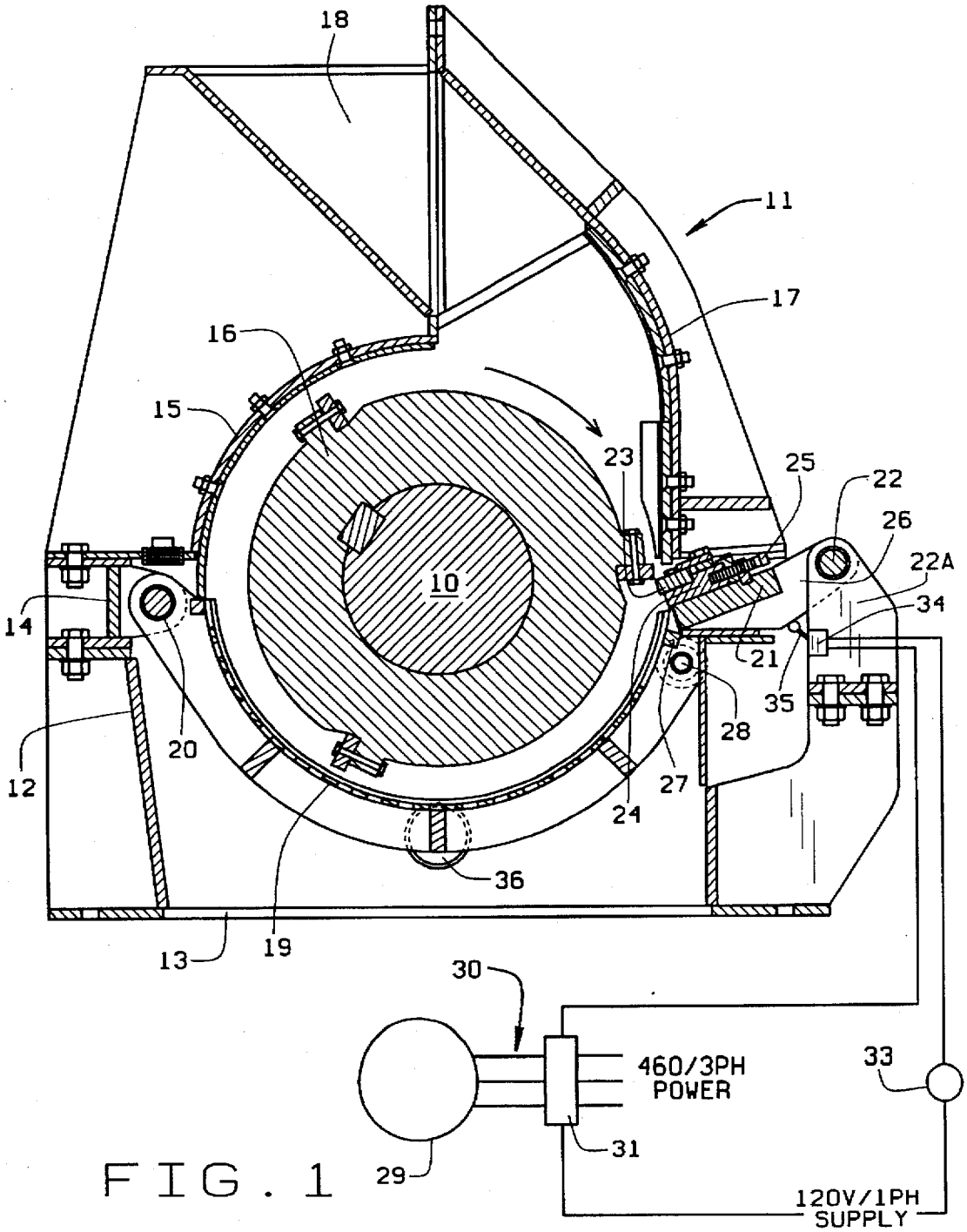
FIG. 1 is a vertical sectional view of a material grinding and granulating material apparatus provided with safety means to prevent damage.

A vertical sectional view of the grinding and granulating apparatus is seen in FIG. 1 in which an electric motor driven shaft 10 is operably mounted in a housing 11 having a base frame 12 formed with a granulated material outlet opening 13. The base 12 supports an annular extension 14 at one side to carry an enclosure 15 to partly define the chamber for the granulating rotor 16 mounted on the shaft 10. At the opposite side there is another enclosing structure 17 which forms part of the material feed chute 18.

The material grinding and granulating rotor is seen in greater detail in the prior U.S. Pat. No. 5,474,239 of Dec. 12, 1995 and will not be repeated in this application as the improvement resides in the safety provisions associated with the screen 19 which is pivotally mounted by a shaft 20 at the extension 14 on the base 12, and the pivotal mounting of a cutter support block 21 on shaft 22. The block 21 carries a cutter 23 mounted on an adjustable slide 24 having an adjustment screw 25.

In the view of FIG. 1, the pivot arm 26 which carries the block 21 is held by a fixed strut 22A in its elevated cutting position by an abutment 27 carried on the adjacent end portion of the screen 19. The screen 19 is retained in operative position by inserting a shear pin 28 into the mounting aperture 29 seen in FIG. 2. When the screen 19 is raised to hold the cutter block in its raised position, as in FIG. 1, the cutter 23 is held in operative position simply by the supporting presence of the abutment 27 on the screen 19.

Normal unjammed position of the material feed rotor 16 is provided for continuous operation of the shaft 10 by its usual electric motor shown schematically. That motor 29 is powered by a three phase 460 volt circuit 30 having a circuit rendered operative by solenoid 31. The solenoid 31 is energized by a 120 volt, single phase line 32 in circuit through a start button 33 and a switch 34. The switch 34 normally has its actuator 35 in contact with the arm 26 for the cutter support. Operation of the start button 33 in the 120 volt circuit energizes the solenoid 31 to close the 460 volt motor circuit to start motor 29 for rotating the shaft 10.

Figure 2:
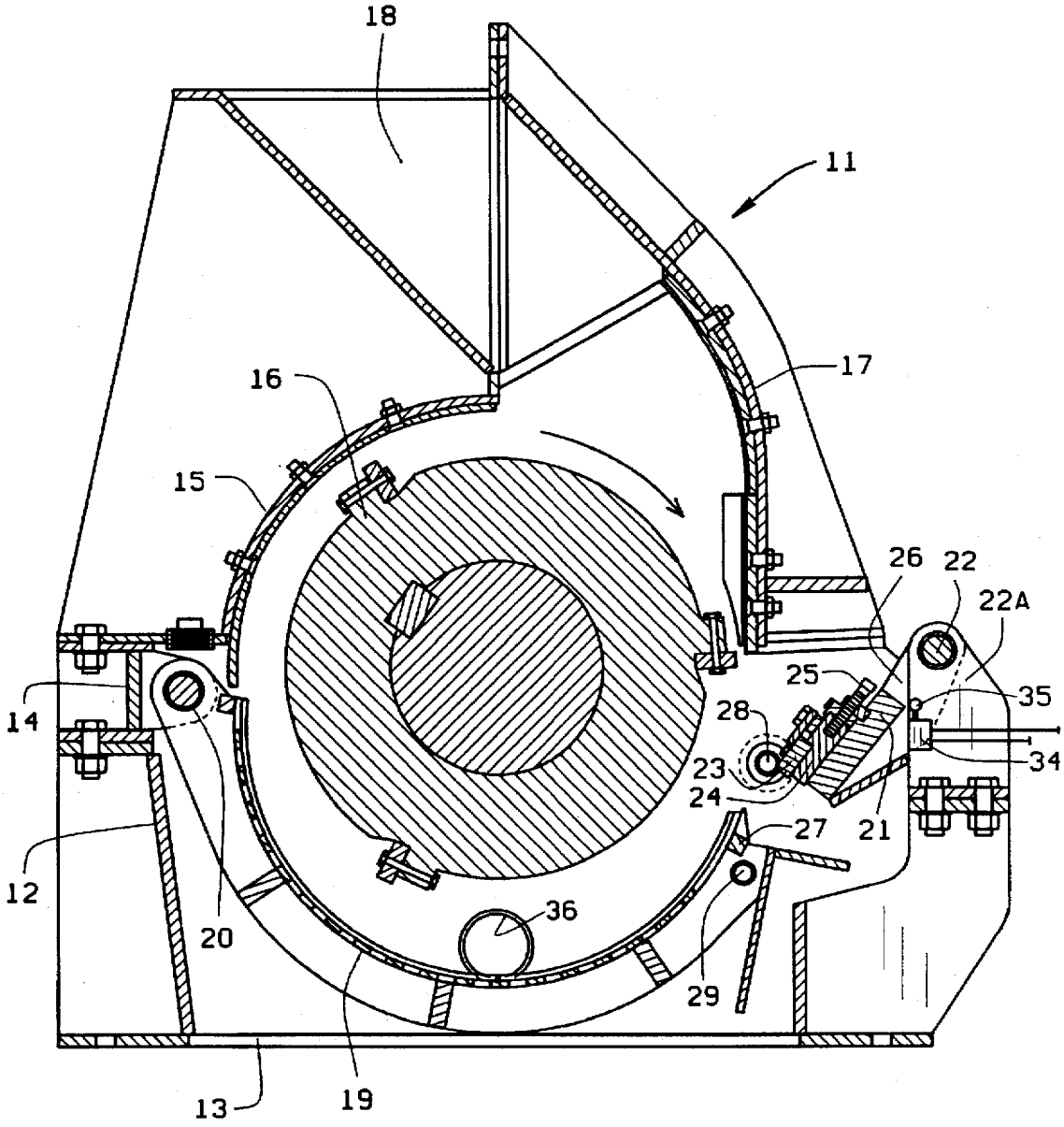
FIG. 2 is a vertical sectional view of the apparatus actuated to open the screen and cutter upon experiencing a jam.

Normal operation of the apparatus receives material to be granulated to a size small enough to pass the screen 19. The problem has been encountered that a tramp material enters the feed chute 18 and is sufficiently hard to resist reduction by the cutter 23. The driving torque of the shaft 10 is powerful enough to damage the housing structure 17 but now the cutter 23 will yield to overcome the problem of housing destruction, and power supply to the driving motor 29 is interrupted so the feed of material stops. The cut off of power to the motor 29 is shown schematically in FIG. 1 by the provision of a circuit through the solenoid 31 to power the motor 29, and the safety circuit 32 which is interrupted by the actuation of the switch 34 through the switch arm 35 being moved by the pivot arm 26 to open circuit 32 which drops the solenoid 31 to stop motor 29. The result of moving actuator 35 of the switch 34 is seen in FIG. 2 where the cutter arm 26 has been actuated by the tramp material to shear the pin 28 which releases abutment 27 on screen 19 to pivot out of the way so the cutter arm 26 is fully free to pivot out of the way to allow the tramp material which caused the jam to be free to be removed. Some material with the tramp material will fall through the opening and be caught up in the screen 19. When the screen 19 opens, the material on the screen will accumulate at the clean-out opening 36 for removal.

From the foregoing, it is apparent that a novel scheme for preventing damage to the apparatus has been disclosed to meet the objects and advantages described in the specification, and modifications may be made by those skilled in the art without departing from the spirit of the invention or the scope thereof as represented by the preferred embodiment seen in the drawings.

We claim:

1. Material shredding apparatus comprising:

a) a housing assembly with material inlet and shredded material outlet;

b) a shaft mounted rotor having material feed elements spaced around the periphery of said rotor;

c) material shredding cutter carried by a support arm having a pivot attachment to said housing adjacent said rotor;

d) shredded material screen pivotably mounted on said housing assembly to assume a position between said rotor and said shredded material outlet, said screen having a support element thereon in position to abut with said cutter carrier support arm;

e) separate pivot means for said shredding cutter support arm and for said material screen, said separate pivot means being spaced apart for allowing said shredding cutter support arm and said material screen to independently separate from said shaft mounted rotor in said housing assembly; and f) a shear pin in said housing assembly in position to releasably hold said material screen adjacent said rotor and said support element in abutment with said support arm and shear in response to a load to allow said material screen and said support arm to separate.

2. Material shredder apparatus having electric motor driving a material shredding rotor on a shaft and in which said apparatus comprises:

a) a housing assembly with material inlet and shredded material outlet and a motor driven shaft operable between said inlet and outlet;

b) a material shredding rotor carried on said motor driven shaft, said rotor having material driving elements thereon to propel material from said inlet to said outlet;

c) a material shredding cutter pivotally mounted in said housing assembly in operative position adjacent to the path of material moved by said material driving elements;

d) screen means pivotally mounted in said housing assembly in operative position to receive shredder material from said rotor, said screen means being in abutment with said pivotally mounted shredding cutter to hold said cutter in operative position;

e) a shear pin engaged in said screen means for releasably retaining said screen means and cutter in operative positions;

f) electrical circuit means to supply electric power to the motor for driving said shaft; and g) switch means in said electrical circuit means for interrupting current supply to the motor for driving said shaft in response to shearing of said shear pin to release said screen means and said cutter and stop current supply to the motor driving said shaft.

3. The material shredder apparatus set forth in claim 2 wherein said pivotally mounted material shredding cutter includes a lever arm having a pivot connection with said housing assembly to render said shredding cutter movable between a material shredding position relative to said shredding rotor and a position spaced from said shredding rotor to permit material to pass said shredding cutter to said outlet.

4. The material shredder apparatus set forth in claim 2 wherein said screen means is supported from a pivot shaft spaced from said shredding cutter, said screen means being free on shearing of said shear pin to pivot out of abutment with said shredding cutter.

* * * * *